US008136592B2

(12) United States Patent
Hsu et al.

(10) Patent No.: US 8,136,592 B2
(45) **Date of Patent: *Mar. 20, 2012**

(54) METHODS FOR PRODUCING OIL AND/OR GAS

(75) Inventors: Chia-Fu Hsu, Rijswijk (NL); Ronald Jan Schoonebeek, Amsterdam (NL)

(73) Assignee: Shell Oil Company, Houston, TX (US)

( * ) Notice: Subject to any disclaimer, the term of this patent is extended or adjusted under 35 U.S.C. 154(b) by 34 days.

This patent is subject to a terminal disclaimer.

(21) Appl. No.: 11/836,006

(22) Filed: Aug. 8, 2007

(65) Prior Publication Data

US 2008/0087425 A1 Apr. 17, 2008

Related U.S. Application Data

(60) Provisional application No. 60/822,014, filed on Aug. 10, 2006.

(51) Int. Cl.
*E21B 43/00* (2006.01)

(52) U.S. Cl. ..... 166/266; 166/400

(58) Field of Classification Search ..... 166/266, 166/268, 403

See application file for complete search history.

(56) References Cited

U.S. PATENT DOCUMENTS

| | | | | |
|---|---|---|---|---|
| 2,330,934 | A | 10/1943 | Thacker | 23/206 |
| 2,492,719 | A | 12/1949 | Thacker | 23/206 |
| 2,636,810 | A | 4/1953 | Marisic | 23/206 |
| 2,670,801 | A | 3/1954 | Sherborne | 166/21 |
| 3,087,788 | A | 4/1963 | Porter | 23/181 |
| 3,345,135 | A | 10/1967 | Kerr et al. | 23/206 |
| 3,366,452 | A | 1/1968 | Wynne | 23/204 |
| 3,387,888 | A * | 6/1968 | Shock et al. | 299/4 |
| 3,393,733 | A | 7/1968 | Kuo et al. | 166/8 |
| 3,402,768 | A | 9/1968 | Felsenthal et al. | 166/2 |
| 3,498,378 | A | 3/1970 | Stone et al. | 166/263 |
| 3,512,585 | A * | 5/1970 | Allen | 166/245 |
| 3,581,821 | A | 6/1971 | Ross | 166/245 |
| 3,647,906 | A | 3/1972 | Farley | 260/683 D |
| 3,672,448 | A | 6/1972 | Hoyt | 166/245 |
| 3,724,553 | A | 4/1973 | Snavely, Jr. et al. | 166/304 |
| 3,729,053 | A | 4/1973 | Froning | 166/304 |
| 3,754,598 | A | 8/1973 | Holloway, Jr. | 166/249 |
| 3,794,114 | A | 2/1974 | Brandon | 166/249 |

(Continued)

FOREIGN PATENT DOCUMENTS

EP 0581026 A1 2/1994

(Continued)

OTHER PUBLICATIONS

"Gases—Specific Gravities," The Engineering ToolBox, retrieved Jul. 6, 2011 from http://www.engineeringtoolbox.com/specific-gravities-gases-d_334.html.*

(Continued)

*Primary Examiner* — Angela M DiTrani

(57) ABSTRACT

A method for producing oil and/or gas comprising injecting a miscible enhanced oil recovery formulation into fractures, karsts, and/or vugs of a formation for a first time period from a first well; producing oil and/or gas from the fractures, karsts, and/or vugs from a second well for the first time period; injecting a miscible enhanced oil recovery formulation into the fractures, karsts, and/or vugs for a second time period from the second well; and producing oil and/or gas from the fractures, karsts, and/or vugs from the first well for the second time period.

15 Claims, 10 Drawing Sheets

U.S. PATENT DOCUMENTS

| | | | | | |
|---|---|---|---|---|---|
| 3,805,892 | A | | 4/1974 | Haynes, Jr. | 166/245 |
| 3,822,748 | A | * | 7/1974 | Allen et al. | 166/269 |
| 3,823,777 | A | | 7/1974 | Allen et al. | 166/266 |
| 3,837,399 | A | * | 9/1974 | Allen et al. | 166/266 |
| 3,838,737 | A | * | 10/1974 | Allen et al. | 166/269 |
| 3,838,738 | A | * | 10/1974 | Redford et al. | 166/271 |
| 3,840,073 | A | | 10/1974 | Allen et al. | 166/274 |
| 3,847,221 | A | | 11/1974 | Allen et al. | 166/274 |
| 3,850,245 | A | | 11/1974 | Allen et al. | 166/274 |
| 3,878,892 | A | | 4/1975 | Allen et al. | 166/267 |
| 3,908,762 | A | * | 9/1975 | Redford | 166/402 |
| 3,927,185 | A | | 12/1975 | Meadow et al. | 423/443 |
| 3,983,939 | A | * | 10/1976 | Brown et al. | 166/269 |
| 4,008,764 | A | | 2/1977 | Allen | 166/266 |
| 4,057,613 | A | | 11/1977 | Meadow et al. | 423/443 |
| 4,122,156 | A | | 10/1978 | Kittrell et al. | 423/443 |
| 4,182,416 | A | | 1/1980 | Trantham et al. | 166/245 |
| 4,305,463 | A | | 12/1981 | Zakiewicz | 106/245 |
| 4,393,937 | A | | 7/1983 | Dilgren et al. | 166/272 |
| 4,475,592 | A | * | 10/1984 | Pachovsky | 166/272.3 |
| 4,476,113 | A | | 10/1984 | Young et al. | 424/161 |
| 4,488,976 | A | | 12/1984 | Dilgren et al. | 252/8.55 D |
| 4,512,400 | A | * | 4/1985 | Simon | 166/245 |
| 4,543,434 | A | | 9/1985 | Chang | 585/310 |
| 4,550,779 | A | | 11/1985 | Zakiewicz | 166/248 |
| 4,744,417 | A | * | 5/1988 | Alameddine | 166/245 |
| 4,822,938 | A | | 4/1989 | Audeh et al. | 585/324 |
| 4,963,340 | A | | 10/1990 | Audeh et al. | 423/444 |
| 5,065,821 | A | | 11/1991 | Huang et al. | 166/245 |
| 5,076,358 | A | | 12/1991 | Kissel | 166/275 |
| 5,120,935 | A | | 6/1992 | Nenniger | 392/305 |
| 5,607,016 | A | | 3/1997 | Butler | 166/263 |
| 5,609,845 | A | | 3/1997 | Cimini et al. | 423/648.1 |
| 5,803,171 | A | | 9/1998 | McCaffery et al. | 166/245 |
| 5,826,656 | A | | 10/1998 | McGuire et al. | 166/305.1 |
| 6,136,282 | A | | 10/2000 | Fisher | 423/220 |
| 6,149,344 | A | | 11/2000 | Eaton | 405/128 |
| 6,241,019 | B1 | | 6/2001 | Davidson et al. | 166/249 |
| 6,405,797 | B2 | | 6/2002 | Davidson et al. | 166/249 |
| 6,497,855 | B1 | | 12/2002 | Wachs | 423/648.1 |
| 6,506,349 | B1 | | 1/2003 | Khanmamedov | 423/210 |
| 6,706,108 | B2 | | 3/2004 | Polston | 106/285 |
| 6,811,683 | B2 | * | 11/2004 | Davis et al. | 208/97 |
| 6,851,473 | B2 | | 2/2005 | Davidson | 166/263 |
| 7,926,561 | B2 | * | 4/2011 | Berg | 166/245 |
| 2001/0008619 | A1 | | 7/2001 | Geus et al. | 423/230 |
| 2002/0134706 | A1 | | 9/2002 | Keller et al. | 208/250 |
| 2003/0047309 | A1 | | 3/2003 | Thomas et al. | 166/265 |
| 2003/0194366 | A1 | | 10/2003 | Srinivas et al. | 423/230 |
| 2004/0022721 | A1 | | 2/2004 | Watson et al. | 423/574.1 |
| 2004/0096381 | A1 | | 5/2004 | Watson et al. | 423/224 |
| 2004/0146288 | A1 | | 7/2004 | Vinegar et al. | 392/301 |
| 2004/0146450 | A1 | | 7/2004 | Stauffer | 423/443 |
| 2004/0159583 | A1 | | 8/2004 | Mesters et al. | 208/208 |
| 2004/0189108 | A1 | | 9/2004 | Dooley | 310/52 |
| 2004/0256097 | A1 | | 12/2004 | Byrd et al. | 166/90.1 |
| 2006/0254769 | A1 | | 11/2006 | Wang et al. | 166/266 |
| 2007/0251686 | A1 | | 11/2007 | Sivrikoz et al. | 166/249 |
| 2008/0023198 | A1 | | 1/2008 | Hsu | 166/268 |
| 2008/0087425 | A1 | | 4/2008 | Hsu et al. | 166/266 |

FOREIGN PATENT DOCUMENTS

| | | | |
|---|---|---|---|
| GB | 1007674 | | 10/1965 |
| GB | 1173344 | | 10/1969 |
| GB | 2379685 | A | 3/2003 |
| WO | WO 9850679 | | 12/1998 |
| WO | WO 2007131976 | A1 | 11/2007 |
| WO | WO 2007131977 | A1 | 11/2007 |
| WO | WO 2008003732 | A1 | 1/2008 |
| WO | WO 2008034777 | A1 | 3/2008 |

OTHER PUBLICATIONS

"Athabasca oil sands" Wikipedia, retrieved Jul. 6, 2011 from http://en.wikipedia.org/wiki/Athabasca_oil_sands.*

"Carbon disulfide" Wikipedia, retrieved Jul. 6, 2011 from http://en.wikipedia.org/wiki/Carbon_disulfide.*

"Permeability (earth sciences)" Wikipedia, retrieved Jul. 6, 2011 from http://en.wikipedia.org/wiki/Permeability_(earth_sciences).*

"Water-Density and Specific Weight" The Engineering Toolbox, retrieved Jul. 6, 2011 from http://www.engineeringtoolbox.com/water-density-specific-weight-d_595.html.*

U.S. Appl. No. 11/749,915, filed May 17, 2007.

* cited by examiner

- Prior Art -

METHODS FOR PRODUCING OIL AND/OR GAS

RELATED APPLICATIONS

The present application claims priority to U.S. provisional patent application 60/822,014, filed on Aug. 10, 2006. The present application is related to co-pending U.S. patent application Ser. Nos. 11/409,436, filed on Apr. 19, 2006; and 60/747,908, filed on May 22, 2006. U.S. patent applications 60/822,014, Ser. No. 11/409,436 and 60/747,908 are herein incorporated by reference in their entirety.

FIELD OF THE INVENTION

The present disclosure relates to methods for producing oil and/or gas.

BACKGROUND OF THE INVENTION

Enhanced Oil Recovery (EOR) may be used to increase oil recovery in fields worldwide. There are three main types of EOR, thermal, chemical/polymer and gas injection, which may be used to increase oil recovery from a reservoir, beyond what can be achieved by conventional means—possibly extending the life of a field and boosting the oil recovery factor.

Thermal enhanced recovery works by adding heat to the reservoir. The most widely practiced form is a steam-drive, which reduces oil viscosity so that it can flow to the producing wells. Chemical flooding increases recovery by reducing the capillary forces that trap residual oil. Polymer flooding improves the sweep efficiency of injected water. Miscible injection works in a similar way to chemical flooding. By injecting a fluid that is miscible with the oil, trapped residual oil can be recovered.

Referring to FIG. 1, there is illustrated prior art system 100. System 100 includes underground formation 102, underground formation 104, underground formation 106, and underground formation 108. Production facility 110 is provided at the surface. Well 112 traverses formations 102 and 104, and terminates in formation 106. The portion of formation 106 is shown at 114. Oil and gas are produced from formation 106 through well 112, to production facility 110. Gas and liquid are separated from each other, gas is stored in gas storage 116 and liquid is stored in liquid storage 118.

U.S. Pat. No. 5,826,656 discloses a method for recovering waterflood residual oil from a waterflooded oil-bearing subterranean formation penetrated from an earth surface by at least one well by injecting an oil miscible solvent into a waterflood residual oil-bearing lower portion of the oil-bearing subterranean formation through a well completed for injection of the oil miscible solvent into the lower portion of the oil-bearing formation; continuing the injection of the oil miscible solvent into the lower portion of the oil-bearing formation for a period of time equal to at least one week; recompleting the well for production of quantities of the oil miscible solvent and quantities of waterflood residual oil from an upper portion of the oil-bearing formation; and producing quantities of the oil miscible solvent and waterflood residual oil from the upper portion of the oil-bearing formation. The formation may have previously been both waterflooded and oil miscible solvent flooded. The solvent may be injected through a horizontal well and solvent and oil may be recovered through a plurality of wells completed to produce oil and solvent from the upper portion of the oil-bearing formation. U.S. Pat. No. 5,826,656 is herein incorporated by reference in its entirety.

There is a need in the art for improved systems and methods for enhanced oil recovery. There is a further need in the art for improved systems and methods for enhanced oil recovery using a solvent, for example through viscosity reduction, chemical effects, and miscible flooding. There is a further need in the art for improved systems and methods for solvent miscible flooding.

SUMMARY OF THE INVENTION

In one aspect, the invention provides a method for producing oil and/or gas from an underground formation comprising injecting an enhanced oil recovery formulation into a first well in the formation; forcing the oil and/or gas towards a second well in the formation; producing the oil and/or gas from the second well; injecting a recovery agent into the second well; forcing the enhanced oil recovery formulation towards the first well; and producing the enhanced oil recovery formulation from the first well.

In another aspect, the invention provides a method for producing oil and/or gas comprising injecting a miscible enhanced oil recovery formulation into fractures, karsts, and/or vugs of a formation for a first time period from a first well; producing oil and/or gas from the fractures, karsts, and/or vugs from a second well for the first time period; injecting a miscible enhanced oil recovery formulation into the fractures, karsts, and/or vugs for a second time period from the second well; and producing oil and/or gas from the fractures, karsts, and/or vugs from the first well for the second time period.

Advantages of the invention include one or more of the following:

Improved systems and methods for enhanced recovery of hydrocarbons from a formation with a solvent.

Improved systems and methods for enhanced recovery of hydrocarbons from a formation with a fluid containing a miscible solvent.

Improved compositions and/or techniques for secondary and/or tertiary recovery of hydrocarbons.

Improved systems and methods for enhanced oil recovery.

Improved systems and methods for enhanced oil recovery using a miscible solvent.

Improved systems and methods for enhanced oil recovery using a compound which is miscible with oil in place.

DETAILED DESCRIPTION OF THE INVENTION

Figure 1:
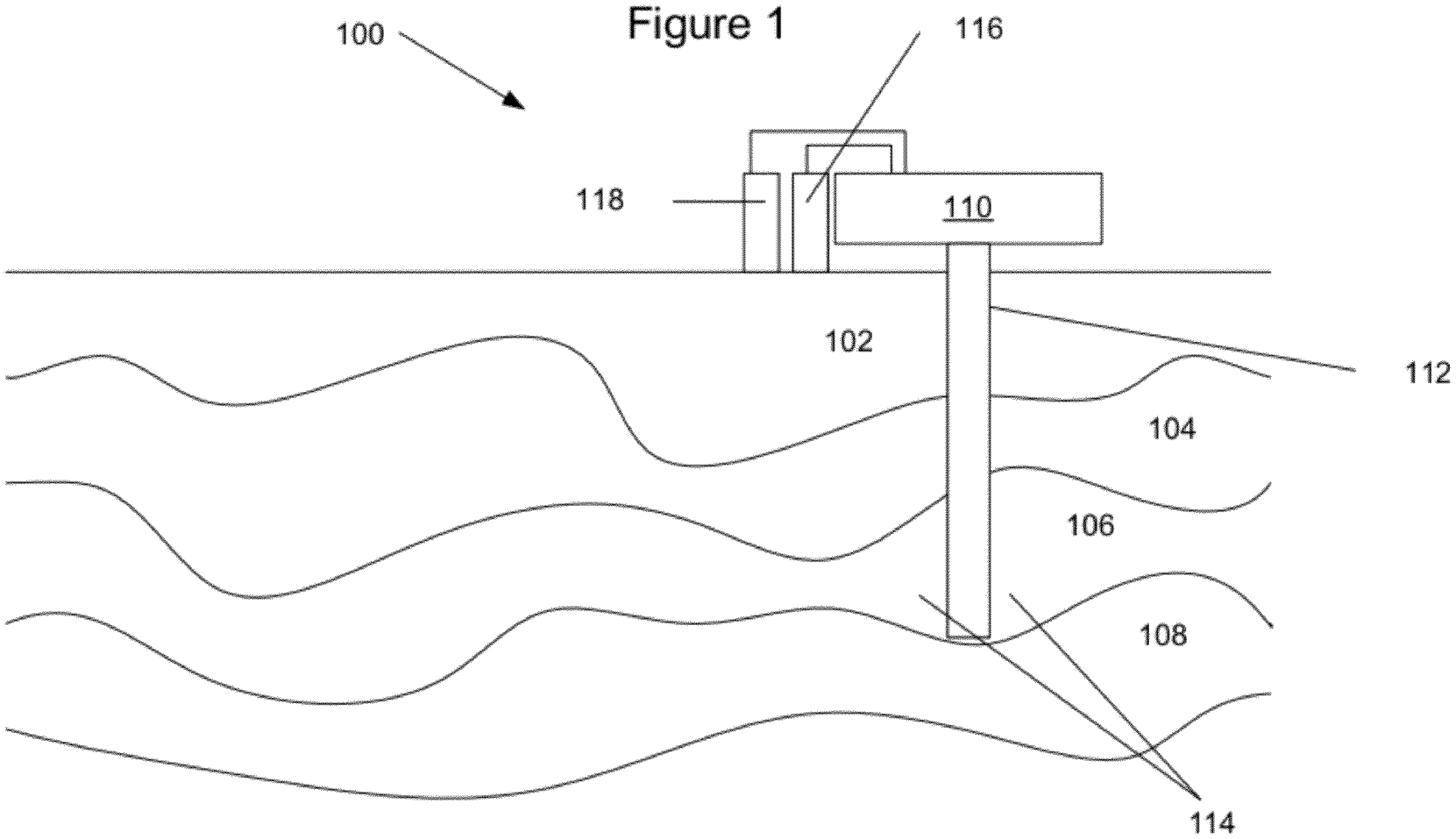
FIG. 1 illustrates an oil and/or gas production system.
Figure 2A:
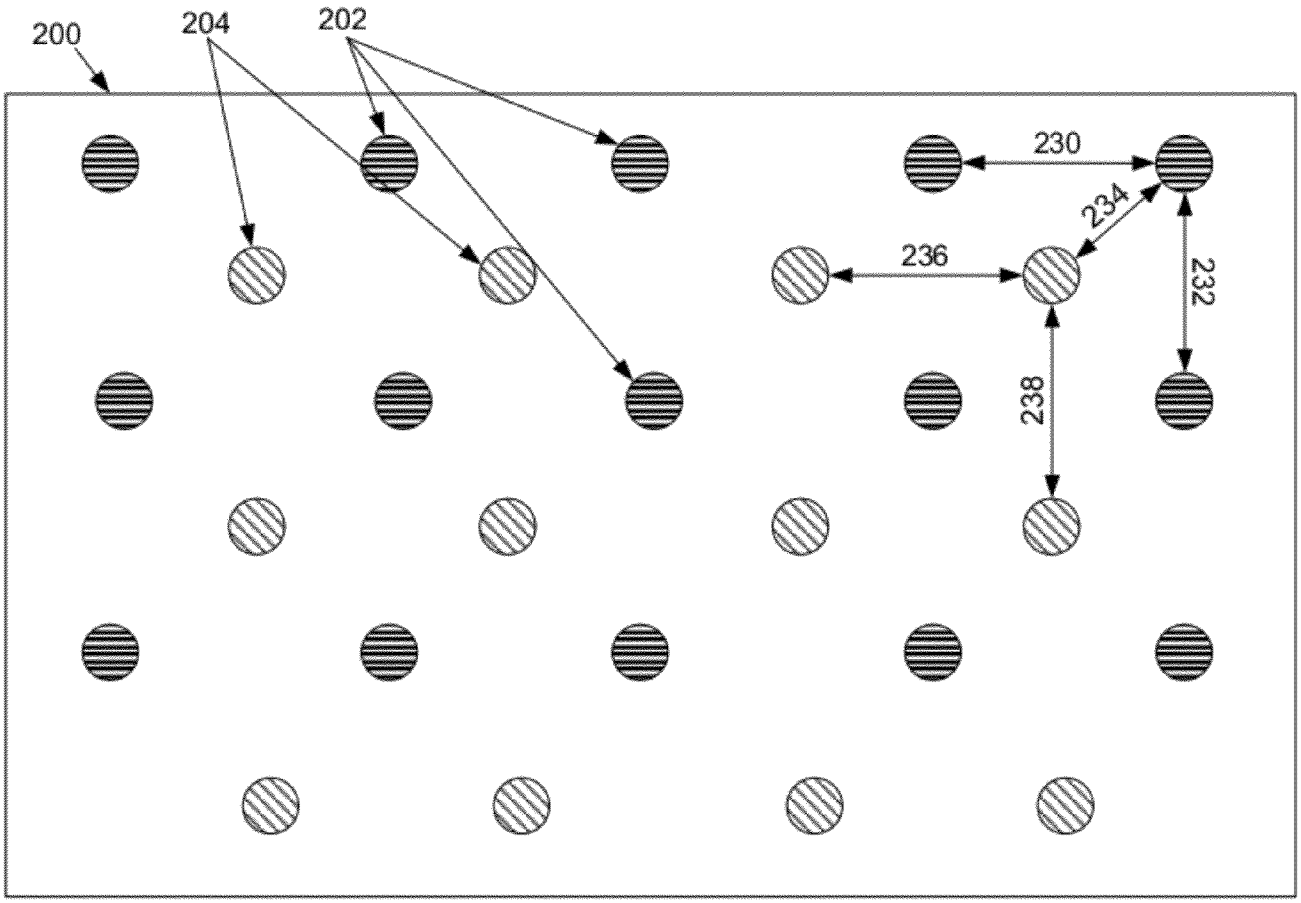
FIG. 2*a* illustrates a well pattern.

Referring now to FIG. 2*a*, in some embodiments, an array of wells 200 is illustrated. Array 200 includes well group 202 (denoted by horizontal lines) and well group 204 (denoted by diagonal lines).

Each well in well group 202 has horizontal distance 230 from the adjacent well in well group 202. Each well in well group 202 has vertical distance 232 from the adjacent well in well group 202.

Each well in well group 204 has horizontal distance 236 from the adjacent well in well group 204. Each well in well group 204 has vertical distance 238 from the adjacent well in well group 204.

Each well in well group 202 is distance 234 from the adjacent wells in well group 204. Each well in well group 204 is distance 234 from the adjacent wells in well group 202.

In some embodiments, each well in well group 202 is surrounded by four wells in well group 204. In some embodiments, each well in well group 204 is surrounded by four wells in well group 202.

In some embodiments, horizontal distance 230 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

In some embodiments, vertical distance 232 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

In some embodiments, horizontal distance 236 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

In some embodiments, vertical distance 238 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

In some embodiments, distance 234 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

In some embodiments, array of wells 200 may have from about 10 to about 1000 wells, for example from about 5 to about 500 wells in well group 202, and from about 5 to about 500 wells in well group 204.

In some embodiments, array of wells 200 is seen as a top view with well group 202 and well group 204 being vertical wells spaced on a piece of land. In some embodiments, array of wells 200 is seen as a cross-sectional side view with well group 202 and well group 204 being horizontal wells spaced within a formation.

The recovery of oil and/or gas with array of wells 200 from an underground formation may be accomplished by any known method. Suitable methods include subsea production, surface production, primary, secondary, or tertiary production. The selection of the method used to recover the oil and/or gas from the underground formation is not critical.

In some embodiments, oil and/or gas may be recovered from a formation into a well, and flow through the well and flowline to a facility. In some embodiments, enhanced oil recovery, with the use of an agent for example steam, water, a surfactant, a polymer flood, and/or a miscible agent such as a carbon disulfide formulation or carbon dioxide, may be used to increase the flow of oil and/or gas from the formation.

In some embodiments, oil and/or gas recovered from a formation may include a sulfur compound. The sulfur compound may include hydrogen sulfide, mercaptans, sulfides and disulfides other than hydrogen disulfide, or heterocyclic sulfur compounds for example thiophenes, benzothiophenes, or substituted and condensed ring dibenzothiophenes, or mixtures thereof.

In some embodiments, a sulfur compound from the formation may be converted into a carbon disulfide formulation. The conversion of at least a portion of the sulfur compound into a carbon disulfide formulation may be accomplished by any known method. Suitable methods may include oxidation reaction of the sulfur compound to sulfur and/or sulfur dioxides, and by reaction of sulfur and/or sulfur dioxide with carbon and/or a carbon containing compound to form the carbon disulfide formulation. The selection of the method used to convert at least a portion of the sulfur compound into a carbon disulfide formulation is not critical.

In some embodiments, a suitable miscible enhanced oil recovery agent may be a carbon disulfide formulation. The carbon disulfide formulation may include carbon disulfide and/or carbon disulfide derivatives for example, thiocarbonates, xanthates and mixtures thereof; and optionally one or more of the following: hydrogen sulfide, sulfur, carbon dioxide, hydrocarbons, and mixtures thereof.

In some embodiments, a suitable method of producing a carbon disulfide formulation is disclosed in copending U.S. patent application Ser. No. 11/409,436, filed on Apr. 19, 2006, now U.S. Pat. No. 7,426,959. U.S. Pat. No. 7,426,959 is herein incorporated by reference in its entirety.

Figure 2B:
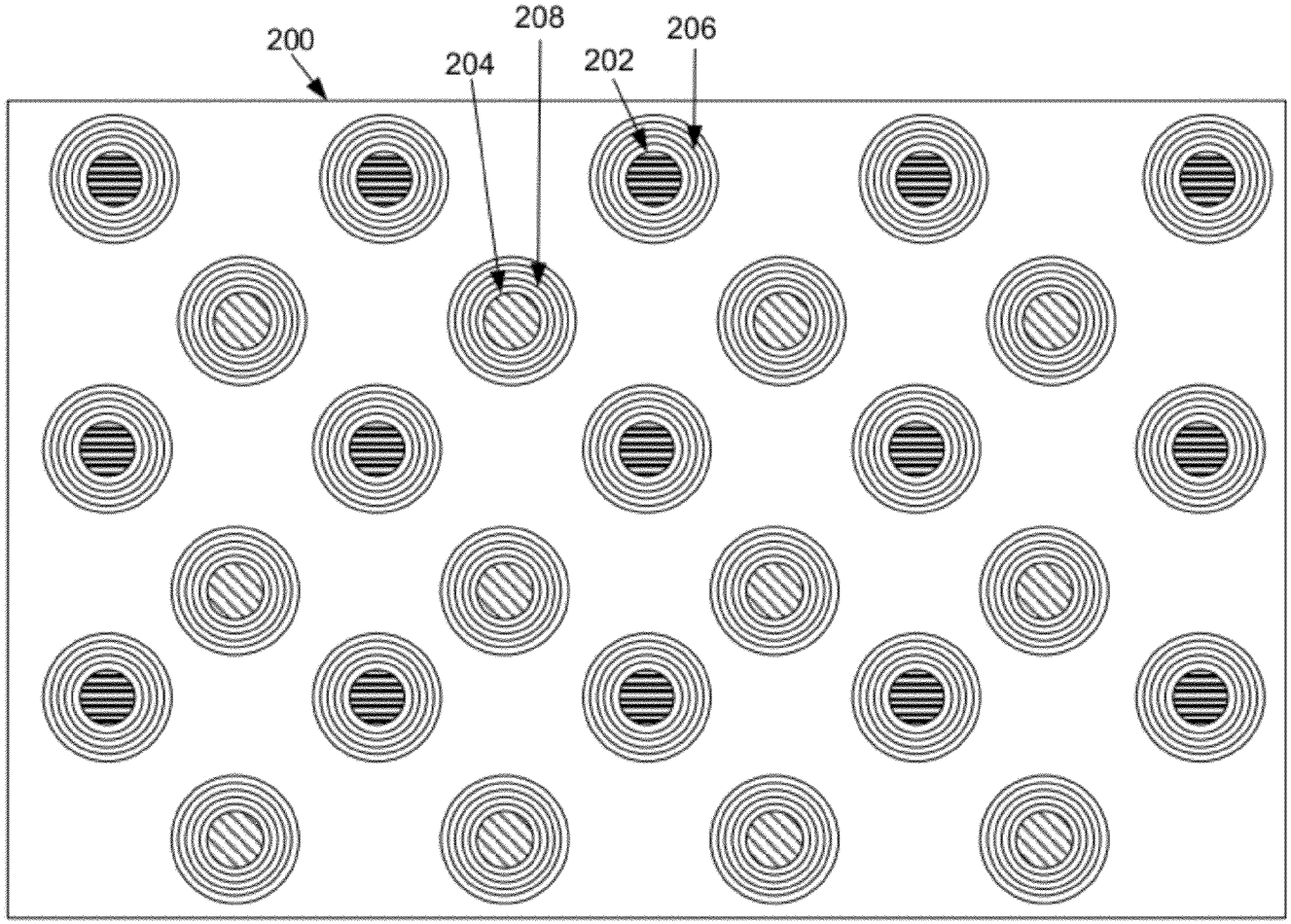
FIGS. 2*b* and 2*c* illustrate the well pattern of FIG. 2*a* during enhanced oil recovery processes.

Referring now to FIG. 2*b*, in some embodiments, array of wells 200 is illustrated. Array 200 includes well group 202 (denoted by horizontal lines) and well group 204 (denoted by diagonal lines).

In some embodiments, a miscible enhanced oil recovery agent is injected into well group 204, and oil is recovered from well group 202. As illustrated, the miscible enhanced oil recovery agent has injection profile 208, and oil recovery profile 206 is being produced to well group 202.

In some embodiments, a miscible enhanced oil recovery agent is injected into well group 202, and oil is recovered from well group 204. As illustrated, the miscible enhanced oil recovery agent has injection profile 206, and oil recovery profile 208 is being produced to well group 204.

In some embodiments, well group 202 may be used for injecting a miscible enhanced oil recovery agent, and well group 204 may be used for producing oil and/or gas from the formation for a first time period; then well group 204 may be used for injecting a miscible enhanced oil recovery agent, and well group 202 may be used for producing oil and/or gas from the formation for a second time period, where the first and second time periods comprise a cycle.

In some embodiments, multiple cycles may be conducted which include alternating well groups 202 and 204 between injecting a miscible enhanced oil recovery agent, and producing oil and/or gas from the formation, where one well group is injecting and the other is producing for a first time period, and then they are switched for a second time period.

In some embodiments, a cycle may be from about 12 hours to about 1 year, or from about 3 days to about 6 months, or from about 5 days to about 3 months. In some embodiments, each cycle may increase in time, for example each cycle may be from about 5% to about 10% longer than the previous cycle, for example about 8% longer.

In some embodiments, a miscible enhanced oil recovery agent or a mixture including a miscible enhanced oil recovery agent may be injected at the beginning of a cycle, and an immiscible enhanced oil recovery agent or a mixture including an immiscible enhanced oil recovery agent may be injected at the end of the cycle. In some embodiments, the beginning of a cycle may be the first 10% to about 80% of a cycle, or the first 20% to about 60% of a cycle, the first 25% to about 40% of a cycle, and the end may be the remainder of the cycle.

In some embodiments, suitable miscible enhanced oil recovery agents include carbon disulfide, hydrogen sulfide, carbon dioxide, octane, pentane, LPG, C2-C6 aliphatic hydrocarbons, nitrogen, diesel, mineral spirits, naptha solvent, asphalt solvent, kerosene, acetone, xylene, trichloroethane, or mixtures of two or more of the preceding, or other miscible enhanced oil recovery agents as are known in the art. In some embodiments, suitable miscible enhanced oil recovery agents are first contact miscible or multiple contact miscible with oil in the formation.

In some embodiments, suitable immiscible enhanced oil recovery agents include water in gas or liquid form, carbon dioxide, nitrogen, air, mixtures of two or more of the preceding, or other immiscible enhanced oil recovery agents as are known in the art. In some embodiments, suitable immiscible enhanced oil recovery agents are not first contact miscible or multiple contact miscible with oil in the formation.

In some embodiments, immiscible and/or miscible enhanced oil recovery agents injected into the formation may be recovered from the produced oil and/or gas and re-injected into the formation.

In some embodiments, oil as present in the formation prior to the injection of any enhanced oil recovery agents has a viscosity of at least about 100 centipoise, or at least about 500 centipoise, or at least about 1000 centipoise, or at least about 2000 centipoise, or at least about 5000 centipoise, or at least about 10,000 centipoise. In some embodiments, oil as present in the formation prior to the injection of any enhanced oil recovery agents has a viscosity of up to about 5,000,000 centipoise, or up to about 2,000,000 centipoise, or up to about 1,000,000 centipoise, or up to about 500,000 centipoise.

Figure 2C:
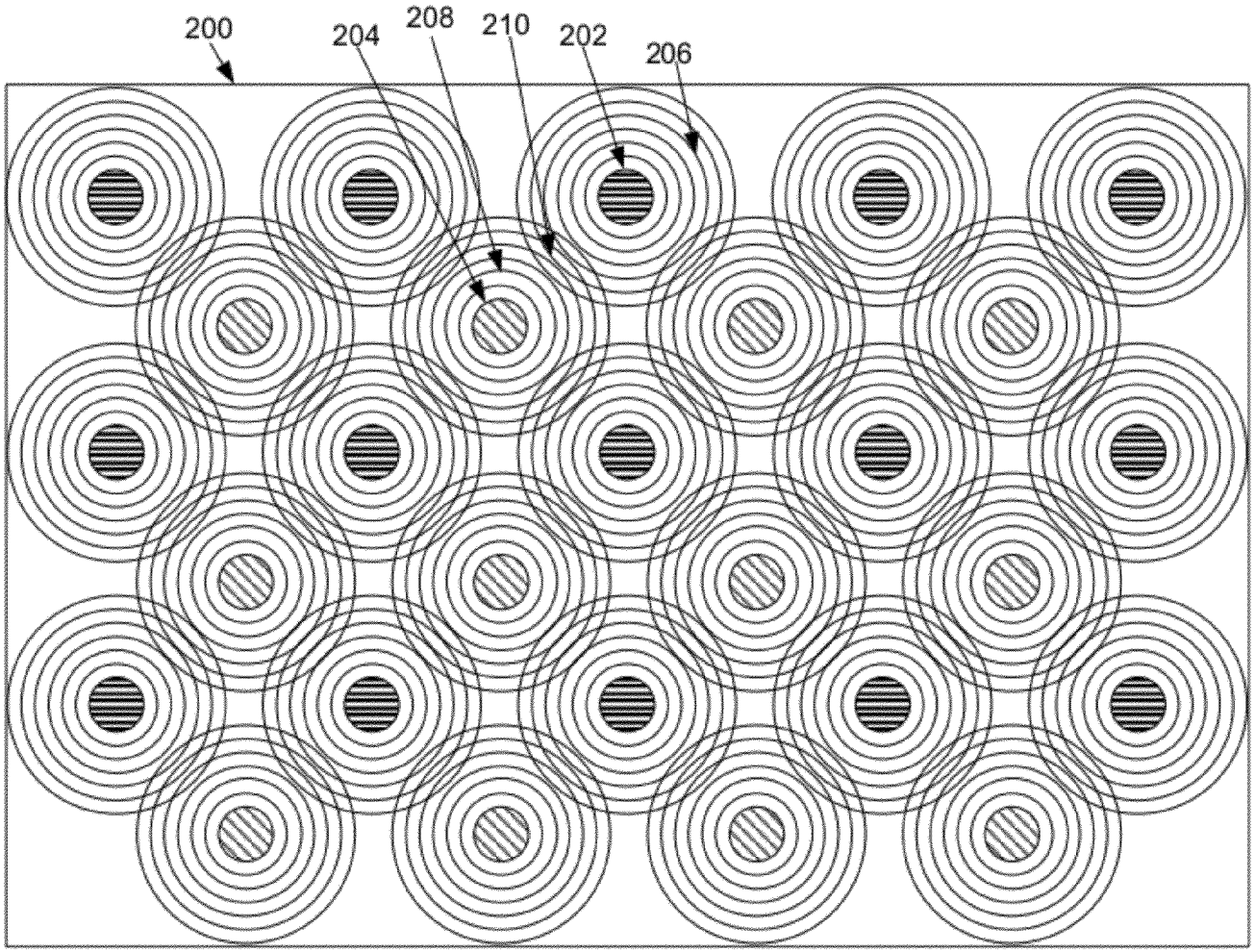

Referring now to FIG. 2*c*, in some embodiments, array of wells 200 is illustrated. Array 200 includes well group 202 (denoted by horizontal lines) and well group 204 (denoted by diagonal lines).

In some embodiments, a miscible enhanced oil recovery agent is injected into well group 204, and oil is recovered from well group 202. As illustrated, the miscible enhanced oil recovery agent has injection profile 208 with overlap 210 with oil recovery profile 206, which is being produced to well group 202.

In some embodiments, a miscible enhanced oil recovery agent is injected into well group 202, and oil is recovered from well group 204. As illustrated, the miscible enhanced oil recovery agent has injection profile 206 with overlap 210 with oil recovery profile 208, which is being produced to well group 204.

Releasing at least a portion of the miscible enhanced oil recovery agent and/or other liquids and/or gases may be accomplished by any known method. One suitable method is injecting the miscible enhanced oil recovery formulation into a single conduit in a single well, allowing carbon disulfide formulation to soak, and then pumping out at least a portion of the carbon disulfide formulation with gas and/or liquids. Another suitable method is injecting the miscible enhanced oil recovery formulation into a first well, and pumping out at least a portion of the miscible enhanced oil recovery formulation with gas and/or liquids through a second well. The selection of the method used to inject at least a portion of the miscible enhanced oil recovery formulation and/or other liquids and/or gases is not critical.

In some embodiments, the miscible enhanced oil recovery formulation and/or other liquids and/or gases may be pumped into a formation at a pressure up to the fracture pressure of the formation.

In some embodiments, the miscible enhanced oil recovery formulation or may be mixed in with oil and/or gas in a formation to form a mixture which may be recovered from a well. In some embodiments, a quantity of the miscible enhanced oil recovery formulation may be injected into a well, followed by another component to force carbon the formulation across the formation. For example air, water in liquid or vapor form, carbon dioxide, other gases, other liquids, and/or mixtures thereof may be used to force the miscible enhanced oil recovery formulation across the formation.

In some embodiments, the miscible enhanced oil recovery formulation may be heated prior to being injected into the formation to lower the viscosity of fluids in the formation, for example heavy oils, paraffins, asphaltenes, etc.

In some embodiments, the miscible enhanced oil recovery formulation may be heated and/or boiled while within the formation, with the use of a heated fluid or a heater, to lower the viscosity of fluids in the formation. In some embodiments, heated water and/or steam may be used to heat and/or vaporize the miscible enhanced oil recovery formulation in the formation.

In some embodiments, the miscible enhanced oil recovery formulation may be heated and/or boiled while within the formation, with the use of a heater. One suitable heater is disclosed in copending U.S. patent application Ser. No. 10/693,816, filed on Oct. 24, 2003, now U.S. Patent App. Pub. No. 2004/0146288 A1. United States Patent Application Publication No. 2004/0146288 A1 is herein incorporated by reference in its entirety.

Figure 3A:
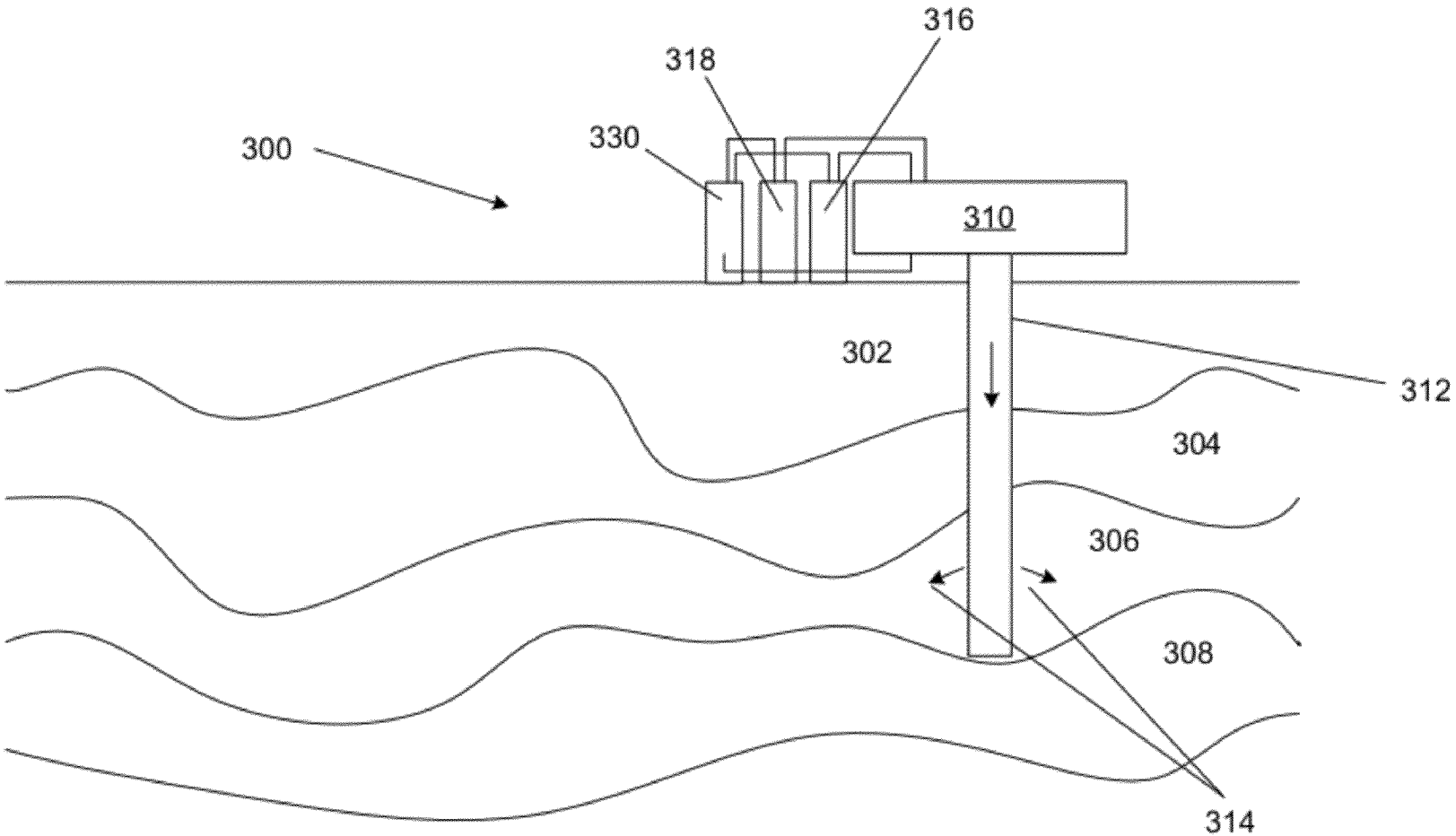
FIGS. 3*a*-3*c* illustrate oil and/or gas production systems.
Figure 3B:
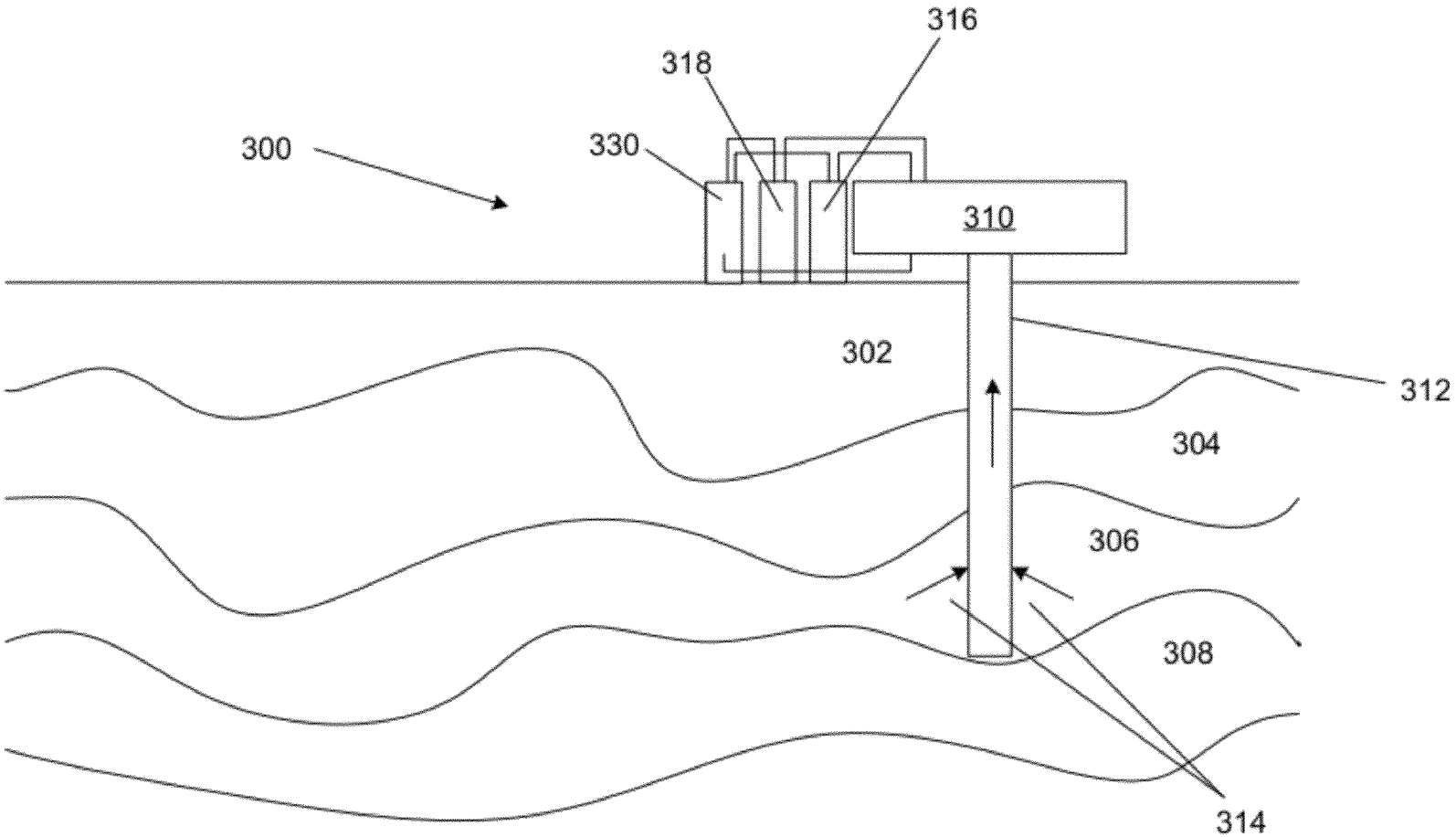

Referring now to FIGS. 3*a* and 3*b*, in some embodiments of the invention, system 300 is illustrated. System 300 includes underground formation 302, underground formation 304, underground formation 306, and underground formation 308. Facility 310 is provided at the surface. Well 312 traverses formations 302 and 304, and has openings in formation 306. Portions 314 of formation 306 may be optionally fractured and/or perforated. During primary production, oil and gas from formation 306 is produced into portions 314, into well 312, and travels up to facility 310. Facility 310 then separates gas, which is sent to gas processing 316, and liquids, which are sent to liquids storage/processing 318. Facility 310 also includes miscible enhanced oil recovery formulation storage 330. As shown in FIG. 3*a*, miscible enhanced oil recovery formulation may be pumped down well 312 that is shown by the down arrow and pumped into formation 306. Miscible enhanced oil recovery formulation may be left to soak in formation for a period of time from about 1 hour to about 15 days, for example from about 5 to about 50 hours.

After the soaking period, as shown in FIG. 3*b*, miscible enhanced oil recovery formulation and oil and/or gas are then produced back up well 312 to facility 310. Facility 310 may be adapted to separate and/or recycle miscible enhanced oil recovery formulation, for example by boiling the formulation, condensing it or filtering or reacting it, then re-injecting the formulation into well 312, for example by repeating the soaking cycle shown in FIGS. 3*a* and 3*b* from about 2 to about 5 times.

In some embodiments, miscible enhanced oil recovery formulation may be pumped into formation 306 below the fracture pressure of the formation, for example from about 40% to about 90% of the fracture pressure.

In some embodiments, well 312 as shown in FIG. 3*a* injecting into formation 306 may be representative of a well in well group 202, and well 312 as shown in FIG. 3*b* producing from formation 306 may be representative of a well in well group 204.

In some embodiments, well 312 as shown in FIG. 3*a* injecting into formation 306 may be representative of a well in well group 204, and well 312 as shown in FIG. 3*b* producing from formation 306 may be representative of a well in well group 202.

Figure 3C:
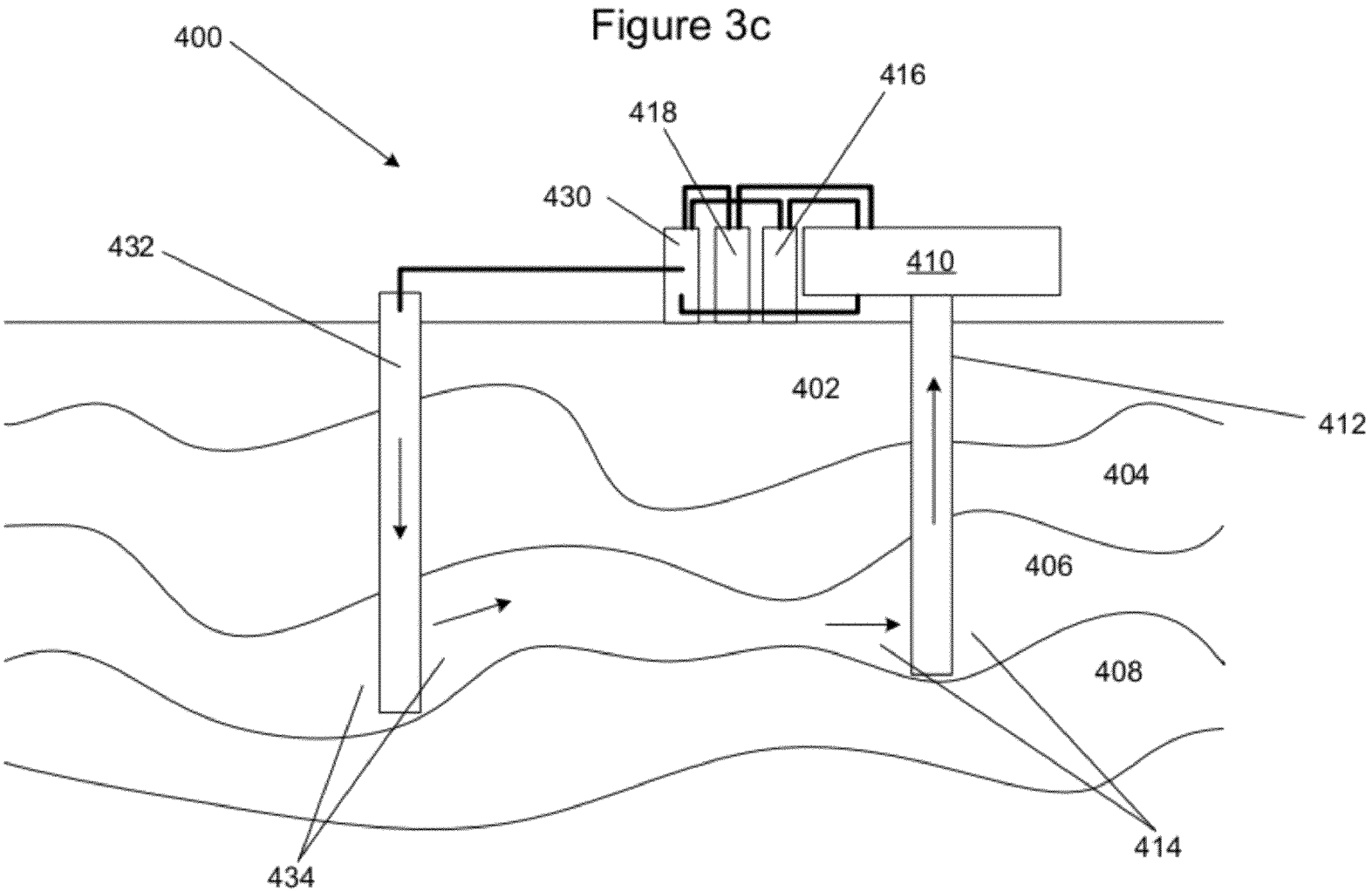

Referring now to FIG. 3*c*, in some embodiments of the invention, system 400 is illustrated. System 400 includes underground formation 402, formation 404, formation 406, and formation 408. Production facility 410 is provided at the surface. Well 412 traverses formation 402 and 404 has openings at formation 406. Portions of formation 414 may be optionally fractured and/or perforated. As oil and gas is produced from formation 406 it enters portions 414, and travels up well 412 to production facility 410. Gas and liquid may be separated, and gas may be sent to gas storage 416, and liquid may be sent to liquid storage 418. Production facility 410 is able to produce and/or store miscible enhanced oil recovery formulation, which may be produced and stored in production/storage 430. Hydrogen sulfide and/or other sulfur containing compounds from well 412 may be sent to miscible enhanced oil recovery formulation production/storage 430. Miscible enhanced oil recovery formulation is pumped down well 432, to portions 434 of formation 406. Miscible enhanced oil recovery formulation traverses formation 406 to aid in the production of oil and gas, and then the miscible enhanced oil recovery formulation, oil and/or gas may all be produced to well 412, to production facility 410. Miscible enhanced oil recovery formulation may then be recycled, for example by boiling the formulation, condensing it or filtering or reacting it, then re-injecting the formulation into well 432.

In some embodiments, a quantity of miscible enhanced oil recovery formulation or miscible enhanced oil recovery formulation mixed with other components may be injected into well 432, followed by another component to force miscible enhanced oil recovery formulation or miscible enhanced oil recovery formulation mixed with other components across formation 406, for example air; water in gas or liquid form; carbon dioxide; nitrogen; water mixed with one or more salts, polymers, and/or surfactants; carbon dioxide; other gases; other liquids; and/or mixtures thereof.

In some embodiments, well 412 which is producing oil and/or gas is representative of a well in well group 202, and well 432 which is being used to inject miscible enhanced oil recovery formulation is representative of a well in well group 204.

In some embodiments, well 412 which is producing oil and/or gas is representative of a well in well group 204, and well 432 which is being used to inject miscible enhanced oil recovery formulation is representative of a well in well group 202.

Figure 4:
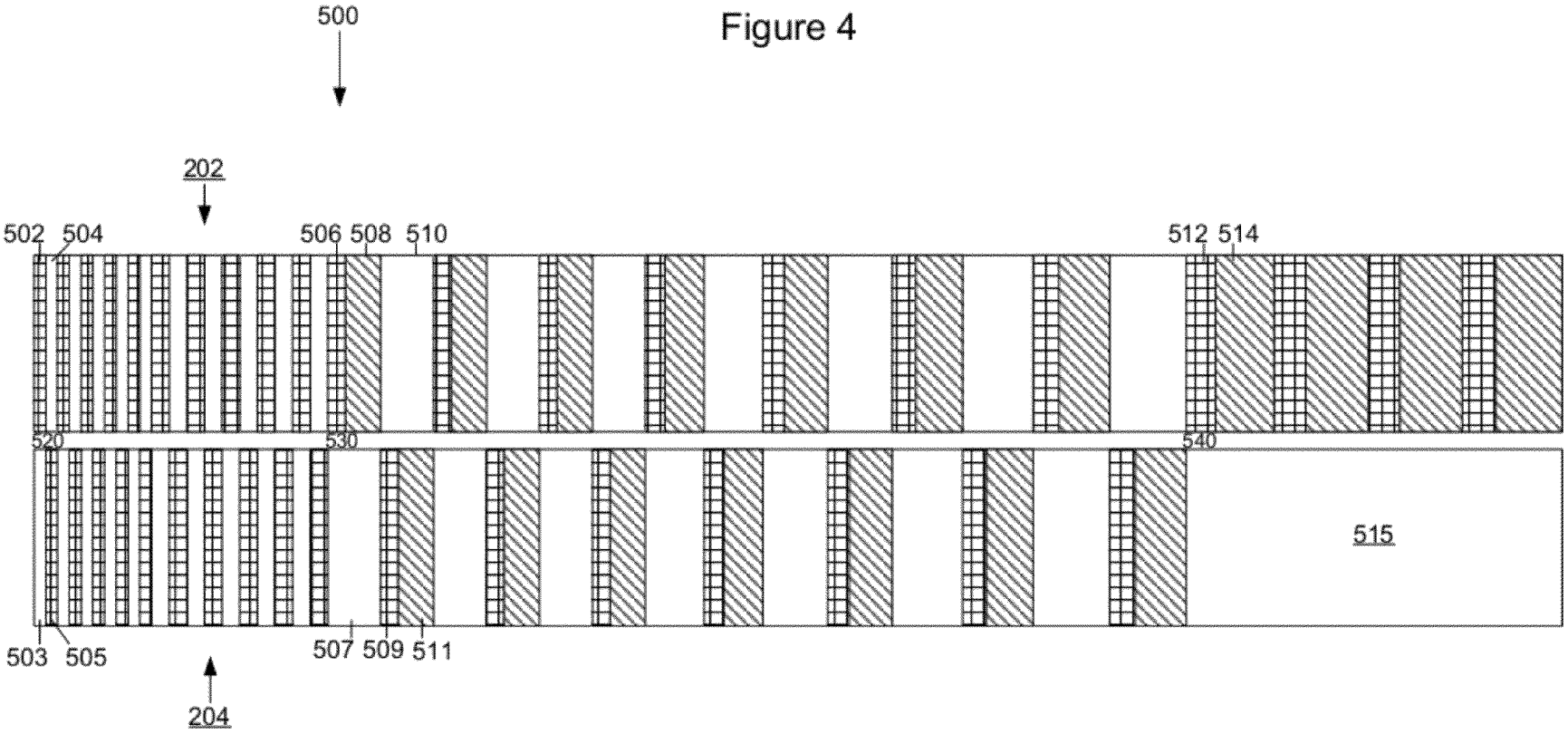
FIG. 4 illustrates an oil and/or gas production method.

Referring now to FIG. 4, in some embodiments of the invention, method 500 is illustrated. Method 500 includes injecting a miscible enhanced oil recovery formulation indicated by checkerboard pattern; injecting an immiscible enhanced oil recovery formulation indicated by diagonal pattern; and producing oil and/or gas from a formation indicated by white pattern.

Injection and production timing for well group 202 is shown by the top timeline, while injection and production timing for well group 204 is shown by the bottom timeline.

In some embodiments, at time 520, miscible enhanced oil recovery formulation is injected into well group 202 for time period 502, while oil and/or gas is produced from well group 204 for time period 503. Then, miscible enhanced oil recovery formulation is injected into well group 204 for time period 505, while oil and/or gas is produced from well group 202 for time period 504. This injection/production cycling for well groups 202 and 204 may be continued for a number of cycles, for example from about 5 to about 25 cycles.

In some embodiments, at time 530, there may be a cavity in the formation due to oil and/or gas that has been produced during time 520. During time 530, only the leading edge of cavity may be filled with a miscible enhanced oil recovery formulation, which is then pushed through the formation with an immiscible enhanced oil recovery formulation. Miscible enhanced oil recovery formulation may be injected into well group 202 for time period 506, then immiscible enhanced oil recovery formulation may be injected into well group 202 for time period 508, while oil and/or gas may be produced from well group 204 for time period 507. Then, miscible enhanced oil recovery formulation may be injected into well group 204 for time period 509, then immiscible enhanced oil recovery formulation may be injected into well group 204 for time period 511, while oil and/or gas may be produced from well group 202 for time period 510. This injection/production cycling for well groups 202 and 204 may be continued for a number of cycles, for example from about 5 to about 25 cycles.

In some embodiments, at time 540, there may be a significant hydraulic communication between well group 202 and well group 204. Miscible enhanced oil recovery formulation may be injected into well group 202 for time period 512, then immiscible enhanced oil recovery formulation may be injected into well group 202 for time period 514 while oil and/or gas may be produced from well group 204 for time period 515. The injection cycling of miscible and immiscible enhanced oil recovery formulations into well group 202 while producing oil and/or gas from well group 204 may be continued as long as desired, for example as long as oil and/or gas is produced from well group 204.

In some embodiments, periods 502, 503, 504, and/or 505 may be from about 6 hours to about 10 days, for example from about 12 hours to about 72 hours, or from about 24 hours to about 48 hours.

In some embodiments, each of periods 502, 503, 504, and/or 505 may increase in length from time 520 until time 530.

In some embodiments, each of periods 502, 503, 504, and/or 505 may continue from time 520 until time 530 for about 5 to about 25 cycles, for example from about 10 to about 15 cycles.

In some embodiments, period 506 is from about 10% to about 50% of the combined length of period 506 and period 508, for example from about 20% to about 40%, or from about 25% to about 33%.

In some embodiments, period 509 is from about 10% to about 50% of the combined length of period 509 and period 511, for example from about 20% to about 40%, or from about 25% to about 33%.

In some embodiments, the combined length of period 506 and period 508 is from about 2 days to about 21 days, for example from about 3 days to about 14 days, or from about 5 days to about 10 days.

In some embodiments, the combined length of period 509 and period 511 is from about 2 days to about 21 days, for example from about 3 days to about 14 days, or from about 5 days to about 10 days.

In some embodiments, the combined length of period 512 and period 514 is from about 2 days to about 21 days, for example from about 3 days to about 14 days, or from about 5 days to about 10 days.

Figure 5:
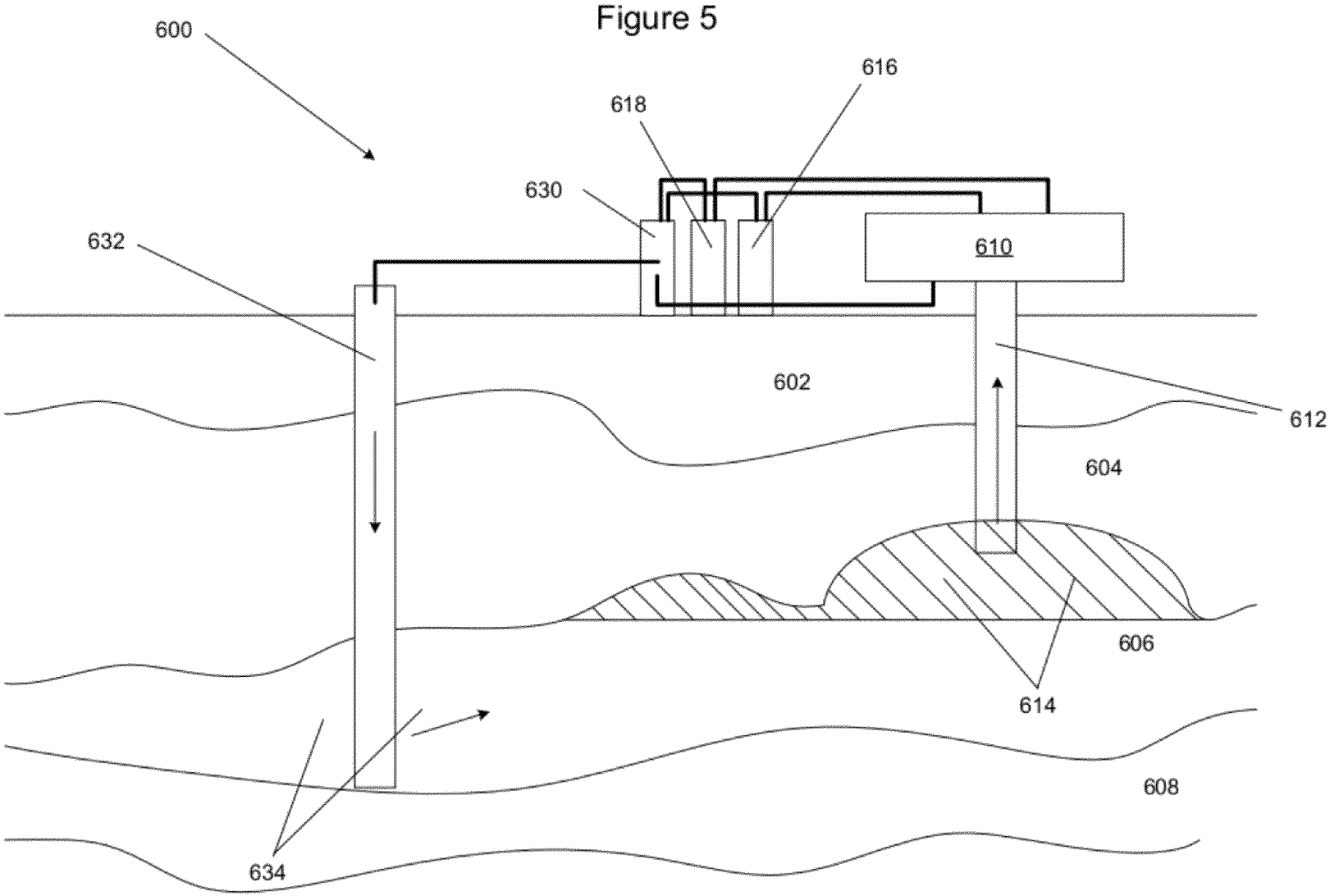
FIG. 5 illustrates an oil and/or gas production system.

Referring now to FIG. 5, in some embodiments of the invention, system 600 is illustrated. System 600 includes underground formation 602, formation 604, formation 606, and formation 608. Production facility 610 is provided at the surface. Well 612 traverses formation 602 and 604 has openings at formation 606. The oil and/or gas may be trapped in the upper portions of formation 606, which may include dome structure 614. As oil and gas is produced from the upper portions of formation 606, which may include dome 614, it travels up well 612 to production facility 610. Gas and liquid may be separated, and gas may be sent to gas storage 616, and liquid may be sent to liquid storage 618. Production facility 610 is able to produce and/or store enhanced oil recovery formulation, which may be produced and stored in production/storage 630. Hydrogen sulfide and/or other sulfur containing compounds from well 612 may be sent to enhanced oil recovery formulation production/storage 630.

Enhanced oil recovery formulation is pumped down well 632, to portions 634 of formation 606. Enhanced oil recovery formulation is denser than the oil and/or gas in dome 614, and causes a buoyancy for oil and/or gas to trap it in the upper portions of formation 606, including dome 614. Enhanced oil recovery formulation traverses formation 606 to aid in the production of oil and gas, and then the enhanced oil recovery formulation may all be produced to well 612, to production facility 610. Enhanced oil recovery formulation may then be recycled, for example by boiling the formulation, condensing it or filtering or reacting it, then re-injecting the formulation into well 632.

After a sufficient portion of the oil and/or gas has been produced to well, there is still a large volume of enhanced oil recovery formulation in formation 606. To recover the enhanced oil recovery formulation, a gas or liquid less dense than the enhanced oil recovery formulation is injected into well 612, and the enhanced oil recovery formulation is recovered from well 632.

In some embodiments, enhanced oil recovery formulation includes carbon disulfide or carbon disulfide formulations. In some embodiments, the less dense gas or liquid includes carbon dioxide, nitrogen, or mixtures including carbon dioxide or nitrogen.

In some embodiments, a quantity of enhanced oil recovery formulation or enhanced oil recovery formulation mixed with other components may be injected into well 632, followed by another component to force enhanced oil recovery formulation or enhanced oil recovery formulation mixed with other components across formation 606, for example air; water in gas or liquid form; carbon dioxide; nitrogen; water mixed with one or more salts, polymers, and/or surfactants; carbon dioxide; other gases; other liquids; and/or mixtures thereof.

In some embodiments, well 612 which is producing oil and/or gas is representative of a well in well group 202, and well 632 which is being used to inject enhanced oil recovery formulation is representative of a well in well group 204.

In some embodiments, well 612 which is producing oil and/or gas is representative of a well in well group 204, and well 632 which is being used to inject enhanced oil recovery formulation is representative of a well in well group 202.

Figure 6:
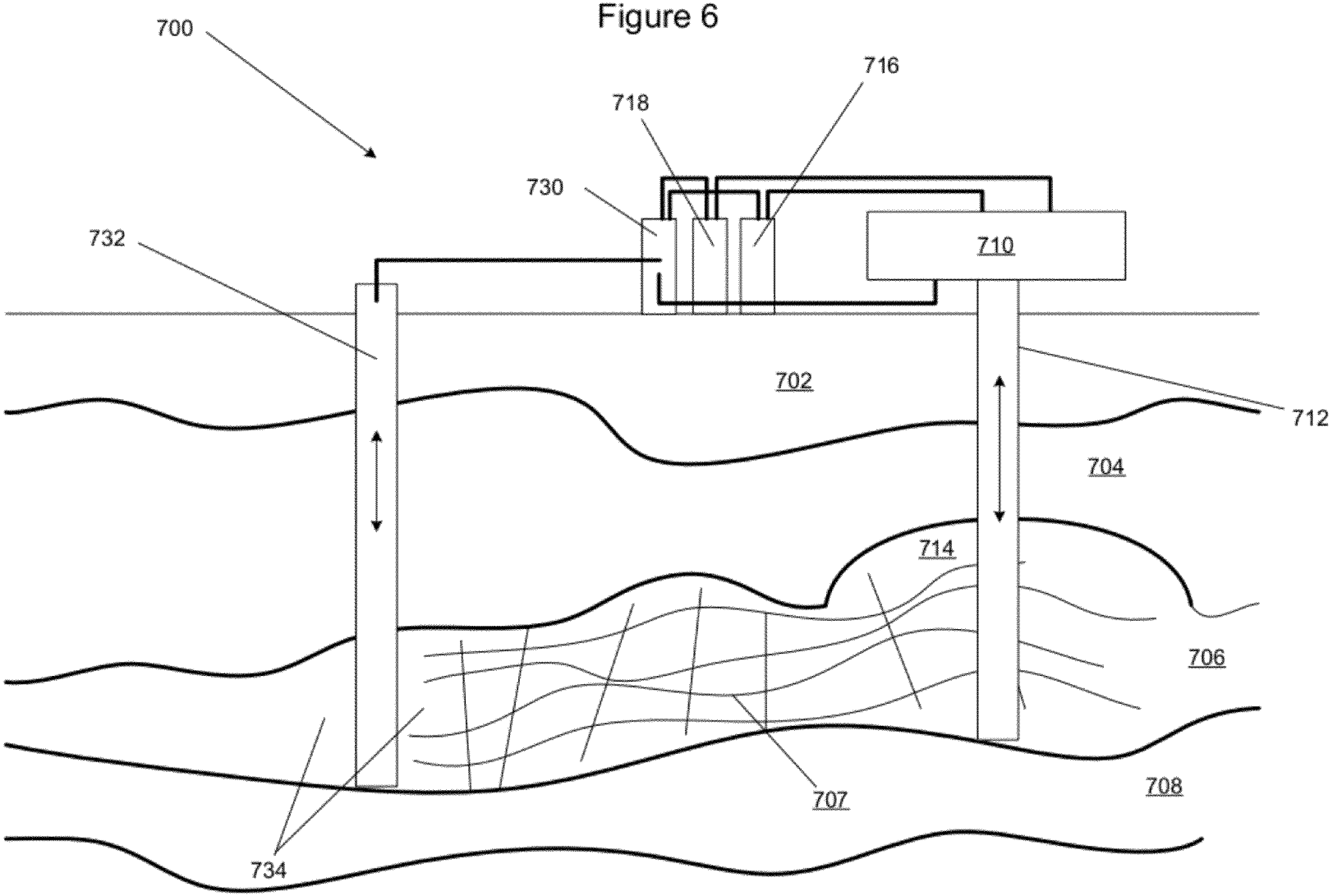
FIG. 6 illustrates an oil and/or gas production system.

Referring now to FIG. 6, in some embodiments of the invention, system 700 is illustrated. System 700 includes underground formation 702, formation 704, formation 706, and formation 708. Production facility 710 is provided at the surface. Well 712 traverses formation 702 and 704 has openings at formation 706. Portions of formation 706 form dome 714, which may trap liquids and/or gases. Formation 706 has fractures, karsts, and/or vugs 707 which provide a low resistance fluid path from well 712 to well 732, and vice versa. As liquids and/or gases are produced from formation 706, they travel up well 712 to production facility 710. Gas and liquid may be separated, and gas may be sent to gas processing/storage 716, and liquid may be sent to liquid processing/storage 718. Production facility 710 is able to produce and/or store miscible enhanced oil recovery formulation, which may be produced and stored in production/storage 730. Hydrogen sulfide and/or other sulfur containing compounds from well 712 may be sent to miscible enhanced oil recovery formulation production/storage 730.

In a first step, miscible enhanced oil recovery formulation is pumped down well 732, to portions 734 of formation 706. Miscible enhanced oil recovery formulation traverses formation 706 to aid in the production of oil and/or gas from fractures, karsts, and/or vugs 707, and then the miscible enhanced oil recovery formulation and oil and/or gas may all be produced to well 712, to production facility 710. Miscible enhanced oil recovery formulation may then be recycled, for example by boiling the formulation, condensing it or filtering or reacting it, then re-injecting the formulation into well 732.

In a second step, the flow is reversed, and miscible enhanced oil recovery formulation is pumped down well 712 to formation 706. Miscible enhanced oil recovery formulation traverses formation 706 to aid in the production of oil and/or gas from fractures, karsts, and/or vugs 707, and then the miscible enhanced oil recovery formulation and oil and/or gas may all be produced to well 732, to production facility 710. Miscible enhanced oil recovery formulation may then be recycled, for example by boiling the formulation, condensing it or filtering or reacting it, then re-injecting the formulation into well 712.

In some embodiments, in a third step, miscible enhanced oil recovery formulation, which is denser than oil and/or gas in formation 706 is injected at the bottom of well 732, near the interface of formations 706 and 708. The miscible enhanced oil recovery formulation injection rate may be adjusted to be near the imbibition rate of the formulation into the matrix surrounding the fractures, karsts, and/or vugs 707. The formulation and oil and/or gas are produced from a top portion of well 712 in dome 714, near the interface of formations 706 and 704. Since oil and/or gas is denser than formulation, formulation causes a buoyancy to oil and/or gas. Oil and/or gas naturally floats on formulation from lower elevation near injection at well 732, to production at well 712.

In some embodiments, as a fourth step, miscible enhanced oil recovery formulation may be recovered by injecting a liquid and/or gas less dense than formulation into a top portion of well 712, which forces formulation down to a bottom portion of well 732. Formulation may then be produced from well 732.

In some embodiments, as a fourth step, miscible enhanced oil recovery formulation may be recovered by injecting steam and/or hot water into a top portion of well 712. The hot water and/or steam evaporates the formulation in the reservoir. The formulation as a vapor can then be effectively produced from well 732.

In some embodiments, miscible enhanced oil recovery formulation includes carbon disulfide or carbon disulfide formulations. In some embodiments, the less dense gas or liquid includes carbon dioxide, nitrogen, or mixtures including carbon dioxide or nitrogen.

In some embodiments, in a third step, miscible enhanced oil recovery formulation, which is less dense than oil and/or gas in formation 706 is injected at the top portion of well 712 in dome 714, near the interface of formations 706 and 704. The miscible enhanced oil recovery formulation injection rate may be adjusted to be near the imbibition rate of the formulation into the matrix surrounding the fractures, karsts, and/or vugs 707. The formulation and oil and/or gas are produced from a bottom of well 732, near the interface of formations 706 and 708. Since oil and/or gas is less dense than formulation, formulation causes the oil and/or gas to sink. Oil and/or gas naturally sinks below formulation from upper elevation near injection at well 712, to lower elevation production at well 732.

In some embodiments, as a fourth step, miscible enhanced oil recovery formulation may be recovered by injecting a liquid and/or gas denser than formulation into a bottom portion of well 732, which forces formulation to float up to top portion of well 712. Formulation may then be produced from well 712.

In some embodiments, the first and second step can be repeated in cycles multiple times, for example until a majority of the oil and/or gas is recovered from fractures, karsts, and/or vugs 707, and/or until miscible enhanced oil recovery formulation can flow relatively freely in the fractures, karsts, and/or vugs 707.

In some embodiments, one first step and one second step make up a cycle, where a cycle may be from about 2 days to about 20 days, for example from about 5 days to about 7 days. In some embodiments, there may be from about 4 to about 20 cycles of the first and second steps.

In some embodiments, a quantity of miscible enhanced oil recovery formulation or miscible enhanced oil recovery formulation mixed with other components may be injected into wells 712 and/or 732, followed by another component to force miscible enhanced oil recovery formulation or miscible enhanced oil recovery formulation mixed with other components across formation 706, for example air; water in gas or liquid form; carbon dioxide; nitrogen; water mixed with one or more salts, polymers, and/or surfactants; carbon dioxide; other gases; other liquids; and/or mixtures thereof.

In some embodiments, well 712 which is producing oil and/or gas is representative of a well in well group 202, and well 732 which is being used to inject miscible enhanced oil recovery formulation is representative of a well in well group 204. In some embodiments, well 712 which is producing oil and/or gas is representative of a well in well group 204, and well 732 which is being used to inject miscible enhanced oil recovery formulation is representative of a well in well group 202.

In some embodiments, oil and/or gas produced may be transported to a refinery and/or a treatment facility. The oil and/or gas may be processed to produced to produce commercial products such as transportation fuels such as gasoline and diesel, heating fuel, lubricants, chemicals, and/or polymers. Processing may include distilling and/or fractionally distilling the oil and/or gas to produce one or more distillate fractions. In some embodiments, the oil and/or gas, and/or the one or more distillate fractions may be subjected to a process of one or more of the following: catalytic cracking, hydrocracking, hydrotreating, coking, thermal cracking, distilling, reforming, polymerization, isomerization, alkylation, blending, and dewaxing.

In one embodiment of the invention, there is disclosed a method for producing oil and/or gas from an underground formation comprising injecting an enhanced oil recovery formulation into a first well in the formation; forcing the oil and/or gas towards a second well in the formation; producing the oil and/or gas from the second well; injecting a recovery agent into the second well; forcing the enhanced oil recovery formulation towards the first well; and producing the enhanced oil recovery formulation from the first well. In some embodiments, the first well further comprises a first array of wells, and the second well further comprises a second array of wells, wherein a well in the first array of wells is at a distance of 10 meters to 1 kilometer from one or more adjacent wells in the second array of wells. In some embodiments, the underground formation is beneath a body of water. In some embodiments, the enhanced oil recovery formulation comprises a miscible enhanced oil recovery formulation, further comprising a mechanism for injecting an immiscible enhanced oil recovery formulation into the formation, after the miscible enhanced oil recovery formulation has been injected into the formation. In some embodiments, the enhanced oil recovery formulation selected from the group consisting of a carbon disulfide formulation, hydrogen sulfide, carbon dioxide, octane, pentane, LPG, C2-C6 aliphatic hydrocarbons, nitrogen, diesel, mineral spirits, naptha solvent, asphalt solvent, kerosene, acetone, xylene, trichloroethane, and mixtures thereof. In some embodiments, the immiscible enhanced oil recovery formulation selected from the group consisting of water in gas or liquid form, carbon dioxide, nitrogen, air, and mixtures thereof. In some embodiments, the first array of wells comprises from 5 to 500 wells, and the second array of wells comprises from 5 to 500 wells. In some embodiments, the enhanced oil recovery formulation comprises a carbon disulfide formulation. In some embodiments, the enhanced oil recovery formulation comprises a carbon disulfide formulation, the method further comprising producing a carbon disulfide formulation. In some embodiments, the underground formation comprises a oil having a viscosity from 100 to 5,000,000 centipoise. In some embodiments, the enhanced oil recovery formulation is denser than the oil and/or gas. In some embodiments, the enhanced oil recovery formulation is denser than the recovery agent. In some embodiments, the recovery agent comprises a gas selected from nitrogen and carbon dioxide. In some embodiments, the oil and/or gas floats on the enhanced oil recovery formulation. In some embodiments, the recovery agent floats on the enhanced oil recovery formulation.

In one embodiment of the invention, there is disclosed a method for producing oil and/or gas comprising injecting a miscible enhanced oil recovery formulation into fractures, karsts, and/or vugs of a formation for a first time period from a first well; producing oil and/or gas from the fractures, karsts, and/or vugs from a second well for the first time period; injecting a miscible enhanced oil recovery formulation into the fractures, karsts, and/or vugs for a second time period from the second well; and producing oil and/or gas from the fractures, karsts, and/or vugs from the first well for the second time period. In some embodiments, the miscible enhanced oil recovery formulation comprises a carbon disulfide formulation. In some embodiments, injecting the miscible enhanced oil recovery formulation comprises injecting a carbon disulfide formulation into the formation in a mixture with one or more of hydrocarbons; sulfur compounds other than carbon disulfide; carbon dioxide; carbon monoxide; or mixtures thereof. In some embodiments, the method also includes heating the miscible enhanced oil recovery formulation prior to injecting the formulation into the formation, or while within the formation. In some embodiments, the miscible enhanced oil recovery formulation is injected at a pressure from 0 to 37,000 kilopascals above the initial reservoir pressure, measured prior to when the injection begins. In some embodiments, the underground formation comprises a permeability from 0.0001 to 15 Darcies, for example a permeability from 0.001 to 1 Darcy. In some embodiments, any oil, as present in the underground formation prior to the injecting the formulation, has a viscosity from 20 to 2,000,000 centipoise, for example from 1000 to 500,000 centipoise. In some embodiments, the method also includes converting at least a portion of the recovered oil and/or gas into a material selected from the group consisting of transportation fuels such as gasoline and diesel, heating fuel, lubricants, chemicals, and/or polymers. In some embodiments, the method also includes repeating the first and second time periods until the formulation flows freely through the fractures, karsts, and/or vugs. In some embodiments, the method also includes imbibing a miscible enhanced oil recovery formulation into a matrix of the formation for a third time period, by injecting the formulation from the first well. In some embodiments, the method also includes producing oil and/or gas from a matrix of the formation from the second well for a third time period. In some embodiments, the method also includes recovering the miscible enhanced oil recovery formulation from the first well by injecting a recovery agent into the second well.

Those of skill in the art will appreciate that many modifications and variations are possible in terms of the disclosed embodiments of the invention, configurations, materials and methods without departing from their spirit and scope. Accordingly, the scope of the claims appended hereafter and their functional equivalents should not be limited by particular embodiments described and illustrated herein, as these are merely exemplary in nature.

The invention claimed is:

1. A method for producing oil from an underground formation comprising:

injecting an enhanced oil recovery formulation into a first well in the formation, where the enhanced oil recovery formulation has a density greater than the oil in the formation and the enhanced oil recovery formulation provides buoyancy to the oil;

forcing the oil towards a second well in the formation;

producing the oil from the second well; and recovering the enhanced oil recovery formulation from the first well by injecting a recovery agent into the second well, wherein, the recovery agent has a density less than that of the enhanced oil recovery formulation.

2. The method of claim 1, wherein the first well further comprises a first array of wells, and the second well further comprises a second array of wells, wherein a well in the first array of wells is at a distance of 10 meters to 1 kilometer from one or more adjacent wells in the second array of wells.

3. The method of claim 2, wherein the first array of wells comprises from 5 to 500 wells, and the second array of wells comprises from 5 to 500 wells.

4. The method of claim 1, wherein the underground formation is beneath a body of water.

5. The method of claim 1, wherein the enhanced oil recovery formulation comprises a miscible enhanced oil recovery formulation, the method further comprising injecting an immiscible enhanced oil recovery formulation into the formation, after the miscible enhanced oil recovery formulation has been injected into the formation.

6. The method of claim 5, wherein the immiscible enhanced oil recovery formulation is selected from the group consisting of water in gas or liquid form, carbon dioxide, nitrogen, air, and mixtures thereof.

7. The method of claim 1, wherein the enhanced oil recovery formulation is selected from the group consisting of a carbon disulfide formulation, hydrogen sulfide, octane, pentane, LPG, C2-C6 aliphatic hydrocarbons, diesel, mineral spirits, naptha solvent, asphalt solvent, kerosene, acetone, xylene, trichloroethane, and mixtures thereof.

8. The method of claim 1, wherein the enhanced oil recovery formulation comprises a carbon disulfide formulation.

9. The method of claim 1, wherein the enhanced oil recovery formulation comprises a carbon disulfide formulation, the method further comprising:

injecting the carbon disulfide formulation into the first well in the formation; and producing the carbon disulfide formulation from the first well.

10. The method of claim 1, wherein any oil, as present in the underground formation prior to the injecting of the enhanced oil recovery formulation into the first well in the formation has a viscosity from 100 to 5,000,000 centipoise.

11. The method of claim 1, wherein the recovery agent comprises a material selected from the group consisting of nitrogen, carbon dioxide, water, steam, and mixtures thereof.

12. The method of claim 11, wherein the recovery agent floats on the enhanced oil recovery formulation.

13. The method of claim 1, wherein the oil floats on the enhanced oil recovery formulation.

14. The method of claim 1, wherein the enhanced oil recovery formulation is injected into fractures, karsts, or vugs of the formation for a first time period from the first well; and oil is produced from the fractures, karst, or vugs from the second well for the first time period.

15. The method of claim 14, further comprising the steps of injecting the enhanced oil recovery formulation into the fractures, karsts, or vugs from the second well for a second time period; and producing oil from the fractures, karsts, or vugs from the first well for the second time period.

* * * * *